US011547891B2

(12) United States Patent
Powell

(10) Patent No.: US 11,547,891 B2
(45) Date of Patent: Jan. 10, 2023

(54) ANKLE EXERCISE DEVICE

(71) Applicant: Angela Powell, Swainsboro, GA (US)

(72) Inventor: Angela Powell, Swainsboro, GA (US)

( * ) Notice: Subject to any disclaimer, the term of this patent is extended or adjusted under 35 U.S.C. 154(b) by 21 days.

(21) Appl. No.: 17/095,498

(22) Filed: Nov. 11, 2020

(65) Prior Publication Data

US 2022/0143449 A1 May 12, 2022

(51) Int. Cl.

| | |
|---|---|
| ***A63B 21/04*** | (2006.01) |
| ***A63B 24/00*** | (2006.01) |
| ***A63B 21/005*** | (2006.01) |
| ***A63B 23/035*** | (2006.01) |
| ***A63B 23/08*** | (2006.01) |
| ***A63B 21/00*** | (2006.01) |

(Continued)

(52) U.S. Cl.

CPC ..... *A63B 21/0435* (2013.01); *A63B 21/0058* (2013.01); *A63B 21/0552* (2013.01); *A63B 21/4034* (2015.10); *A63B 21/4035* (2015.10); *A63B 23/03508* (2013.01); *A63B 23/085* (2013.01); *A63B 23/14* (2013.01); *A63B 24/0087* (2013.01); *A63B 2220/20* (2013.01); *A63B 2225/09* (2013.01)

(58) Field of Classification Search

CPC ..... A63B 21/00058; A63B 21/00069; A63B 21/00178; A63B 21/00185; A63B 21/002; A63B 21/0023; A63B 21/005; A63B 21/0058; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/068; A63B 21/22; A63B 21/4023; A63B 21/4027; A63B 21/4033; A63B 21/4034; A63B 21/4035; A63B 21/4039; A63B 23/035; A63B 23/03508; A63B 23/04; A63B 23/08; A63B 23/085; A63B 23/12; A63B 23/14; A63B 24/0087; A63B 69/0057; A63B 69/0059; A63B 69/0062; A63B 2208/0209; A63B 2220/20; A63B 2225/09

See application file for complete search history.

(56) References Cited

U.S. PATENT DOCUMENTS 3,083,037 A * 3/1963 Gordon ..... A63B 19/04 482/146

3,750,479 A * 8/1973 Gause ..... A63B 22/0023 482/4

(Continued)

*Primary Examiner* — Gary D Urbiel Goldner

(74) *Attorney, Agent, or Firm* — Robert J. Caison

(57) ABSTRACT

An ankle exercise device comprises a base frame, a heel rest, a rotational component, and a plurality of resistance bands. The resistance bands may be connected to the rotational component. The rotational component rotates 90 degrees to orient the resistance bands in either a horizontal or vertical direction. The heel rest may comprise a u-shaped cutout to cup a user's heel. The heel rest is adjustable to align the heads of a user's metatarsals between the resistance bands. With the resistance bands in the horizontal direction, the user may rotate the ankle in the plantarflexion and dorsiflexion directions. With the resistance bands in the vertical direction, the user may rotate the ankle in the inversion and eversion directions.

6 Claims, 7 Drawing Sheets

(51) Int. Cl.
*A63B 21/055* (2006.01)
*A63B 23/14* (2006.01)

(56) References Cited

U.S. PATENT DOCUMENTS 4,302,006 A * 11/1981 Johnson ..... A63B 19/02 280/206
4,640,508 A * 2/1987 Escher ..... A63B 21/222 482/110
4,684,124 A * 8/1987 Escher ..... A63B 21/00061 601/87
4,703,928 A * 11/1987 Escher ..... A63B 21/4025 74/5.22
5,016,874 A * 5/1991 Boardman ..... A63B 21/0552 482/122
5,018,725 A * 5/1991 Cook ..... A63B 21/4035 482/142
5,320,591 A * 6/1994 Harmon ..... A63B 71/0009 482/121
5,472,407 A * 12/1995 Schenck ..... A61H 1/0288 601/40
5,478,299 A * 12/1995 Harmon ..... A63B 71/0009 482/121
5,749,668 A * 5/1998 McIlvain ..... A63B 23/08 482/99
5,752,879 A * 5/1998 Berdut ..... A63B 22/0023 482/142
5,913,749 A * 6/1999 Harmon ..... A63B 21/1672 482/129
5,957,816 A * 9/1999 Staffa ..... A63B 23/0355 482/79
6,063,013 A * 5/2000 Vathappallil ..... A63B 21/151 482/79
6,152,857 A * 11/2000 Gonzalez-Leal .. A63B 21/0552 601/39
6,165,110 A * 12/2000 Gajda ..... A63B 21/06 482/102
6,277,057 B1 * 8/2001 Hayden ..... A63B 21/0083 482/79
6,283,897 B1 * 9/2001 Patton ..... A63B 21/4015 482/79
6,699,162 B2 * 3/2004 Chen ..... A63B 21/4015 482/907
6,733,427 B1 * 5/2004 He ..... A63B 21/00043 482/121
6,878,102 B1 * 4/2005 Commisso ..... A63B 22/18 482/79
7,559,766 B2 * 7/2009 Epley ..... A61B 5/4863 434/34
7,568,715 B2 * 8/2009 Cooney ..... A63B 19/02 280/205
7,758,479 B2 * 7/2010 Husted ..... A63B 21/154 482/92
7,794,367 B2 * 9/2010 Hall ..... A63B 21/4015 482/79
7,887,471 B2 * 2/2011 McSorley ..... A63B 21/0552 482/136
7,935,026 B2 * 5/2011 McSorley ..... A63B 23/16 482/44
8,403,817 B2 * 3/2013 Ferguson ..... A63B 23/08 482/79
9,630,040 B1 * 4/2017 Louis ..... A63B 5/11
10,434,365 B2 * 10/2019 Mack ..... A63B 21/0552
10,583,323 B2 * 3/2020 Little ..... A63B 21/4015
11,020,631 B2 * 6/2021 Walker ..... A63B 21/0085
2004/0009850 A1 * 1/2004 Teff ..... A63B 22/16 482/79
2004/0033869 A1 * 2/2004 Carlson ..... A63B 21/156 482/121
2009/0270231 A1 * 10/2009 Hall ..... A63B 23/10 482/79
2012/0202656 A1 * 8/2012 Dorsay ..... A63B 21/156 482/121
2016/0243396 A1 * 8/2016 Taylor ..... G09B 19/0038
2020/0289874 A1 * 9/2020 Sanders ..... A63B 21/4023

* cited by examiner

ANKLE EXERCISE DEVICE

FIELD OF THE INVENTION

The present invention relates, in general, to exercise devices and, more particularly, to an ankle exercise device.

BACKGROUND

There are approximately 2 million acute ankle sprains in the United States annually. A history of ankle injury is a strong risk factor for future ankle injuries. There is a need for a device to strengthen the ankle properly using correct body mechanics without the need for skilled physical therapy. While strengthening the ankle it is imperative to perform all exercises properly. The current methodology for strengthening the ankle in a skilled physical therapy setting is through the use of resistance bands with the assistance of a therapist. The therapist holds the resistance bands in specific tensioning directions with the appropriate lever arm for specific muscle isolation, while also providing verbal and tactile cues to the patient for proper body mechanics. The goal of the therapist's interventions is to decrease compensatory and/or aberrant movement, decrease the risk of pain, decrease over-use of small muscle groups, and educate the patient.

It is normal for patients to be educated and provided with a home exercise program to perform these same exercises to maintain gains and allow for timely progressions towards goals of strength, stability, and safe mobility when standing, ambulating and mobilizing on all surfaces. Due to the complexity of the musculoskeletal structures and the biomechanics and kinematics of ankle joints, it is difficult for patients to perform the exercises properly without supervision. When performing home exercises, patients often have difficulty with proper band placement, consistent tension on the resistance band, and compensatory unwanted movement at the hip joint. Proper band placement difficulties include difficulties with proper placement of the contralateral foot to achieve the necessary direction of resistance. Inconsistent resistance band tension prevents standardizing and quantifying the load. Aberrant compensatory movement at the hip joint limits ankle strengthening. Further, with these difficulties patient non-compliance becomes a large factor where the patient become discouraged and is no longer able to perform home exercises perpetuating their ankle weakness, eliciting dependence on health care providers and increasing their risk for re-injury.

SUMMARY OF THE INVENTION

This disclosure describes, generally, an ankle exercise device. The device includes a frame, a rotational component, resistance bands, and a heel rest. The ankle exercisers are useful for the strengthening and rehabilitation of ankles and feet for people of all ages (pediatric to geriatric). The rotational component within a rotational frame member and the heel mount base are both attached to the frame.

The rotational component allows for side by side mounting of resistance bands used to resist the motion of the forefoot in either the horizontal or vertical directions. The rotational component rotates 90° between the horizontal and vertical orientations. When the rotational component is aligned with the resistance bands in the horizontal direction, the bands provide resistance to rotation of the ankle in the vertical direction. When the rotational component is aligned with the resistance bands in the vertical direction, the bands provide resistance to rotation of the ankle in the horizontal direction.

The heel rest contains a heel support plate supporting the heel that is rotatably connected to the heel support base through a hinge assembly. The hinge assembly allows the heel support plate to rotate downward in the plantarflexion direction. The heel support base is also adjustable horizontally to align the heads of the metatarsals between the resistance bands and to accommodate various foot size variations.

This device allows patients ease in performing exercises in all four directional planes at the ankle joint without needing to hold a resistance band. Resistance bands are securely placed the same way each time to standardize the workload for measurable strength each use, to determine gains and to allow for progressions of stronger resistance bands and/or to tighten the band consistently each time. Strengthening at the ankle using this device will improve a patient's stability, and allow for improved ankle adaptations on all surfaces when ambulating, standing, and running.

BRIEF DESCRIPTION OF THE DRAWINGS

The present invention will be further described and explained by way of example and with reference to the accompanying drawings, in which.

DETAILED DESCRIPTION OF THE INVENTION

Figure 1:
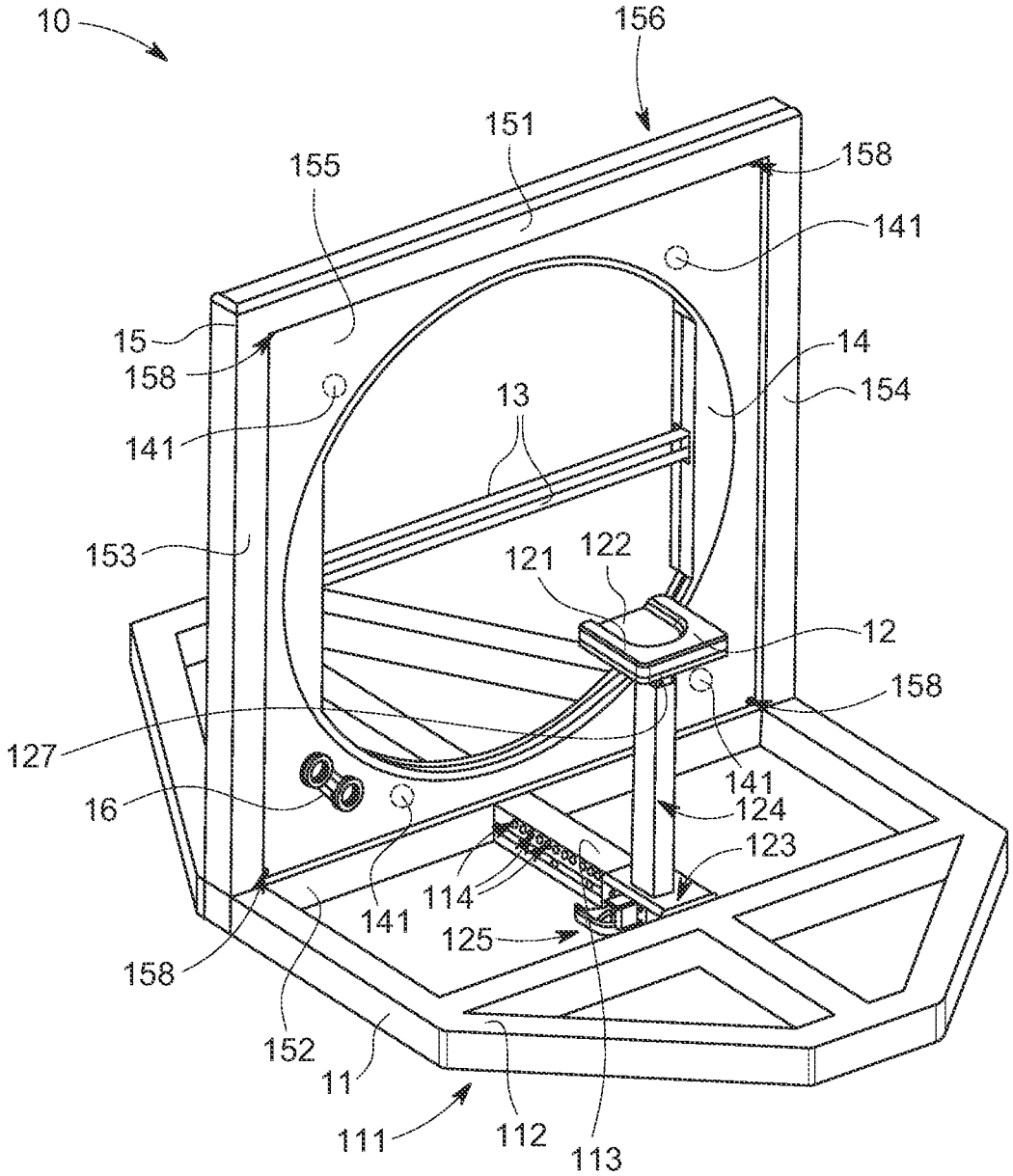
FIG. 1 illustrates a front, perspective view of one embodiment of the ankle exercise device.

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. Some components of the exercise device are not shown in one or more of the figures for clarity and to facilitate explanation of embodiments of the present invention.

It is to be understood that terms such as "left," "right," "top," "bottom," "front," "rear," "side," "height," "length," "width," "upper," "lower," "interior," "exterior," "inner," "outer," and the like that may be used herein merely describe points of reference and do not necessarily limit embodiments of the present disclosure to any particular orientation or configuration. Furthermore, terms such as "first," "second," "third," etc., merely identify one of a number of portions, components, steps, operations, functions, and/or points of reference as disclosed herein, and likewise do not necessarily limit embodiments of the present disclosure to any particular configuration or orientation.

Furthermore, the terms "approximately," "proximate," "minor," and similar terms generally refer to ranges that include the identified value within a margin of 20%, 10% or preferably 5% in certain embodiments, and any values there between.

The ankle exercise device can allow patients to easily perform exercises in all four directions—dorsiflexion, plantarflexion, inversion, and eversion—at the ankle joint without requiring the patient to hold a resistance band. The ankle exercise device can also allow the patient to switch between exercising in the dorsiflexion/plantarflexion directions and exercising in the inversion/eversion directions by rotating a component of the device.

An ankle exercise device 10, shown in FIGS. 1 and 1A, comprises a base frame 11, a heel rest 12, and resistance bands 13. The resistance bands 13 may be connected to a rotational component 14 within a rotational frame member 15. The rotational component 14 rotates 90 degrees within the rotational frame member 15 to orient the resistance bands 13 in either a horizontal or vertical orientation. The resistance bands 13 may be any type of elastic resistance device, including tubing, bands, bungees, and so forth. Each resistance band 13 preferably forms a loop of one continuous elastic material. As can be seen in FIG. 1, the rotational component 14 is depicted as rotated such that the resistance bands 13 are oriented in the horizontal orientation, which allows for exercising the ankle in the plantarflexion and dorsiflexion directions.

The base frame 11 has a planar bottom surface 111 that is large enough to provide stability during use of the device. The base frame 11 may also have a planar top surface 112. The base frame 11 is connected to the rotational frame member 15. According to one embodiment of the present invention, the rotational frame member 15 may be connected to the base frame 11 at approximately a right angle, with the rotational frame member 15 connected to the planar top surface 112. The rotational frame member 15 is in a rectangular shape in this embodiment, but it may be formed of any shape sufficient to contain the rotational component 14. The base frame 11 may provide a general support and framework for various elements of the ankle exercise device. For example, as illustrated in the figure, the base frame 11 may include a plurality of elongate structural members that strengthen the base frame 11.

The rotational frame member 15 may be constructed in a rectangular shape comprising two horizontal bars 151 and 152 connected at about ninety degree angles to two vertical bars 153 and 154. The horizontal bar 152 that is vertically lowermost of the rotational frame member 15 may be integrated with the base frame 11. The rotational frame member 15 may further include a front mounting plate 155 and a back mounting plate 156. The front mounting plate 155 mounts to the rotational frame member 15 on the side closest to the heel rest 12. The back mounting plate 156 mounts to the rotational frame member 15 on the side opposite the heel rest 12. The rotational frame member 15 may be provided with preferably four apertures 158 in the corners for receipt of mounting hardware. The front mounting plate 155 and back mounting plate 156 may be mounted to the rotational frame member 15 via conventional mounting hardware means such as bolts, screws, or rivets.

The rotational component 14 is contained within the rotational frame member 15 between the front mounting plate 155 and back mounting plate 156, and is preferably of a circular shape. The rotational component 14 may be supported by at least two roller bearings 141 that enable the rotational component 14 to rotate within the rotational frame member 15. The bearings 141 may be fixed between the front mounting plate 155 and back mounting plate 156 and support the rotational component 14 while allowing it to freely rotate within the rotational frame member 15. In one embodiment of the present invention, the rotational component 14 may be supported by four bearings 141. The bearings 141 may alternatively be ball bearings provided between the rotational component 14 and a bearing engagement surface within the rotational frame member 15. A locking mechanism 16 is provided in the rotational frame member 15 to lock the rotational component 14 in each of the two desired locations.

The rotational component 14 includes preferably two band mounts 142. The band mounts 142 are preferably on diametrically opposite sides of the rotational component 14. The band mounts 142 each contain preferably two resistance band attachment means 143. Such resistance band attachment means 143 may be hooks, loops, pegs, or any other equivalent manner of securing the resistance bands 13 to the band mounts 142. The resistance band attachment means 143 are preferably about one inch apart.

According to an alternative embodiment, the distance between the resistance band attachment means 143 may be adjustable. Such band attachment means may be slidably adjustable by a conventional means such as a worm drive or rack and pinion. In such an embodiment, the resistance band attachment means 143 are preferably adjustable from about one half inch to about two inches apart.

Figure 2:
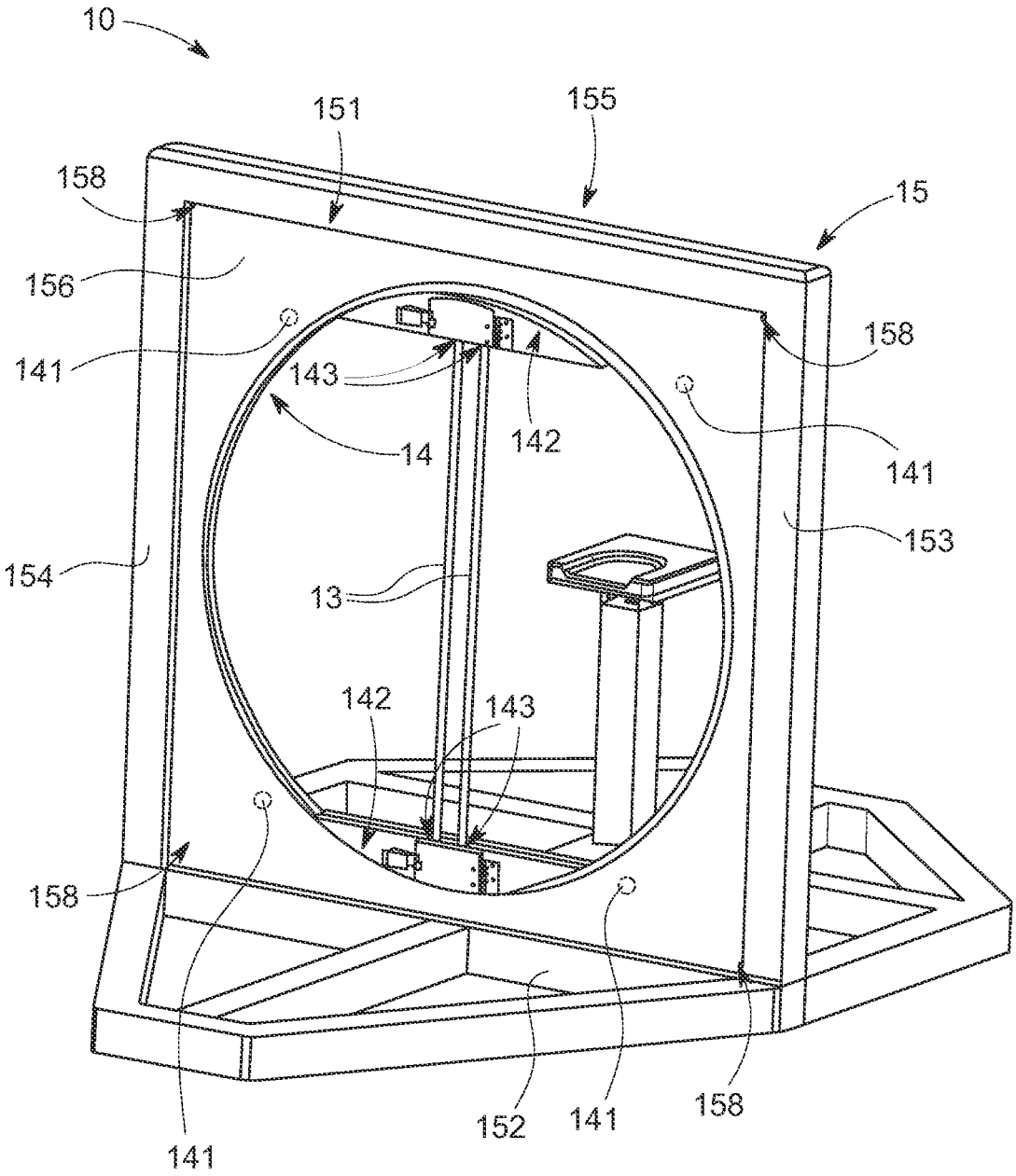
FIG. 2 illustrates a back view of an ankle exercise device as shown in FIG. 1 with the resistance bands in the vertical orientation.

As can be seen in FIG. 2, the rotational component 14 is rotated such that the resistance bands 13 are oriented in the vertical orientation.

The heel rest 12 comprises a heel support plate 121 with a widened "U" shaped cutout 122 appropriately sized to cup a user's heel. The widened "U" shaped cutout 122 is shaped as to allow a user to rotate the forefoot in the inversion and eversion directions with the heel as the pivot point. The opening of the widened "U" shaped cutout 122 is towards the resistance bands 13. The heel support plate 121 is rotatably connected to a heel support base 124 through a hinge assembly 127. The hinge assembly 127 allows the heel support plate 121 to rotate downward in the plantarflexion direction. The hinge assembly 127 prevents the heel support plate 121 from rotating past horizontal in the dorsiflexion direction.

Figure 3:
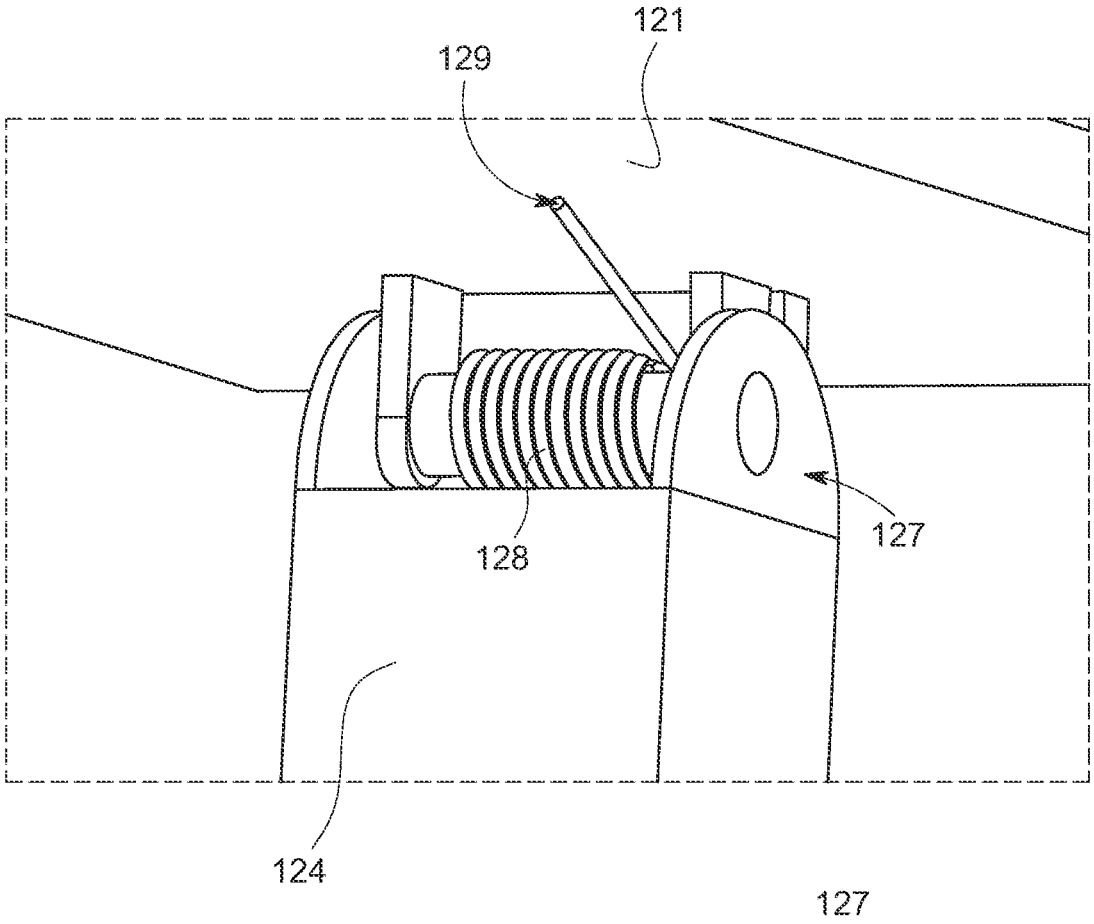
FIG. 3 illustrates a heel rest plate and hinge mechanism with torsion spring.

As can be seen in FIG. 3, in some embodiments the hinge assembly 127 can include a torsion spring 128. The torsion spring 128 can include engagement portions 129. The engagement portions 129 can be configured to engage with the heel support plate 121 to allow the heel support plate 121 to resistibly rotate in the plantarflexion direction and bias the heel support plate 121 to a horizontal position. The hinge assembly 127 may further be configured to prevent the heel support plate 121 from rotating past horizontal in the dorsiflexion direction.

The heel support base 124 has a slidable adjustment mechanism 123 that slides along a central bar 113 of the base frame 11 to allow for foot size accommodation. The slidable adjustment mechanism 123 has a spring loaded locking pin mechanism 125 to engage with multiple holes 114 located along the central bar 113 of the base frame 11. The heel support base 124 is adjustable horizontally to align the heads of the user's metatarsals between the resistance bands 13.

Figure 4:
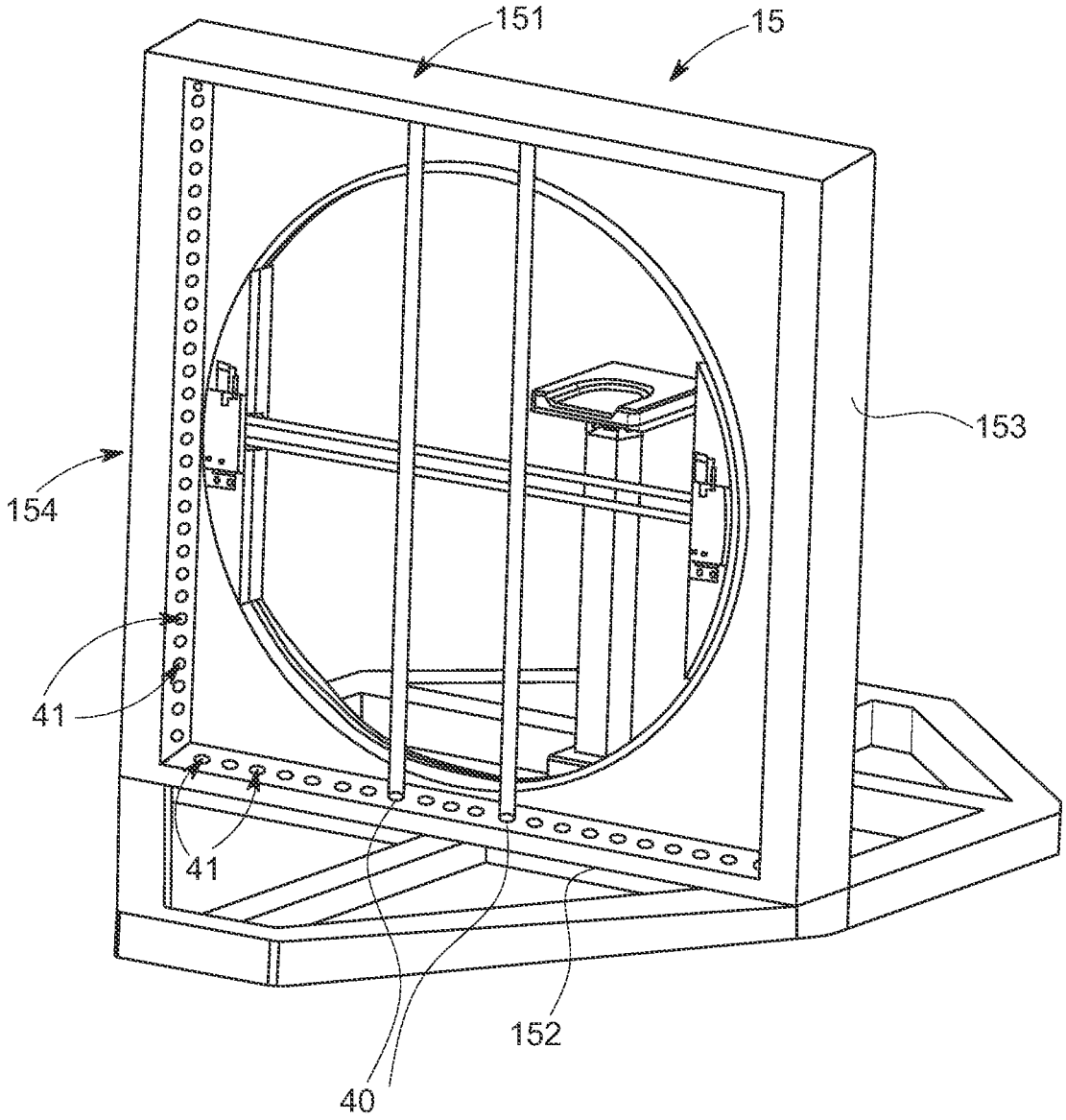
FIG. 4 illustrates an apparatus according to an embodiment of the invention further including isometric bars.

Turning now to FIG. 4, which illustrates an additional embodiment of the ankle exercise device 10. In one embodiment, ankle exercise device 10 may include isometric bars 40, which may be placed perpendicular to the orientation of the resistance bands 13. The isometric bars may connect to opposing sides of the rotational frame member 15, either the two horizontal bars 151 and 152 or the vertical bars 153 and 154. The isometric bars 40 may connect to the rotational frame member 15 through a spring loaded locking pin mechanism to engage with multiple holes 41 in the sides of the rotational frame member 15. These holes may be placed in the horizontal bars 151 and 152 and the vertical bars 153 and 154 to allow adjustable placement of the isometric bars 40 in either orientation. In an additional embodiment, the isometric bar 40 can be adjusted in the horizontal or vertical directions along the rotational frame member 15 by loosening and retightening a knurled knob against a slidable adjustment end of the isometric bar 40.

Figure 5:
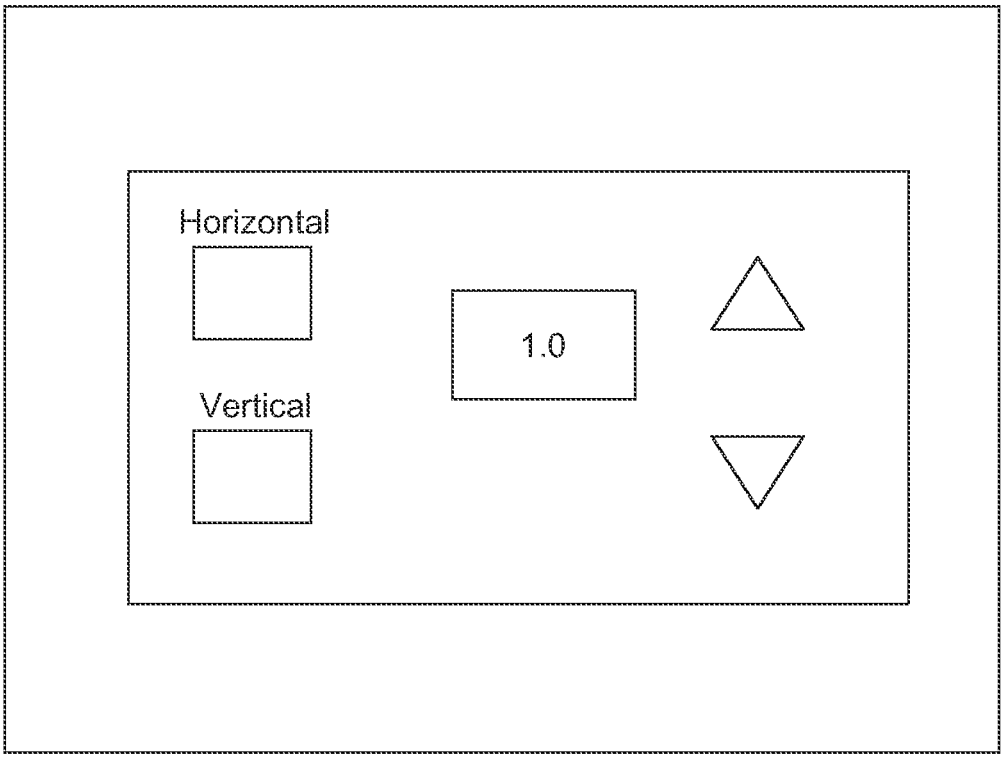
FIG. 5 illustrates an electronic control and display for adjustment of an alternative embodiment of the ankle exercise device.

In an additional embodiment of the present invention, the rotational component 14 may be electronically moved between the vertical and horizontal orientations. The rotational frame member 15 may comprise a conventional electric motor with appropriate control mechanisms to allow the user to select either the horizontal or vertical orientation. Alternatively, the distance between the resistance band attachment means 143 may be electronically adjusted between about zero inches and about twelve inches. In a more preferable embodiment the distance between the resistance bands 13 may be electronically adjusted between about one half inch and about two inches. Additionally, the ankle exercise device may be fitted with an electronic control unit 60 allowing for selection of the horizontal or vertical direction and control of the distance between the resistance bands 13 as depicted in FIG. 5.

Figure 6:
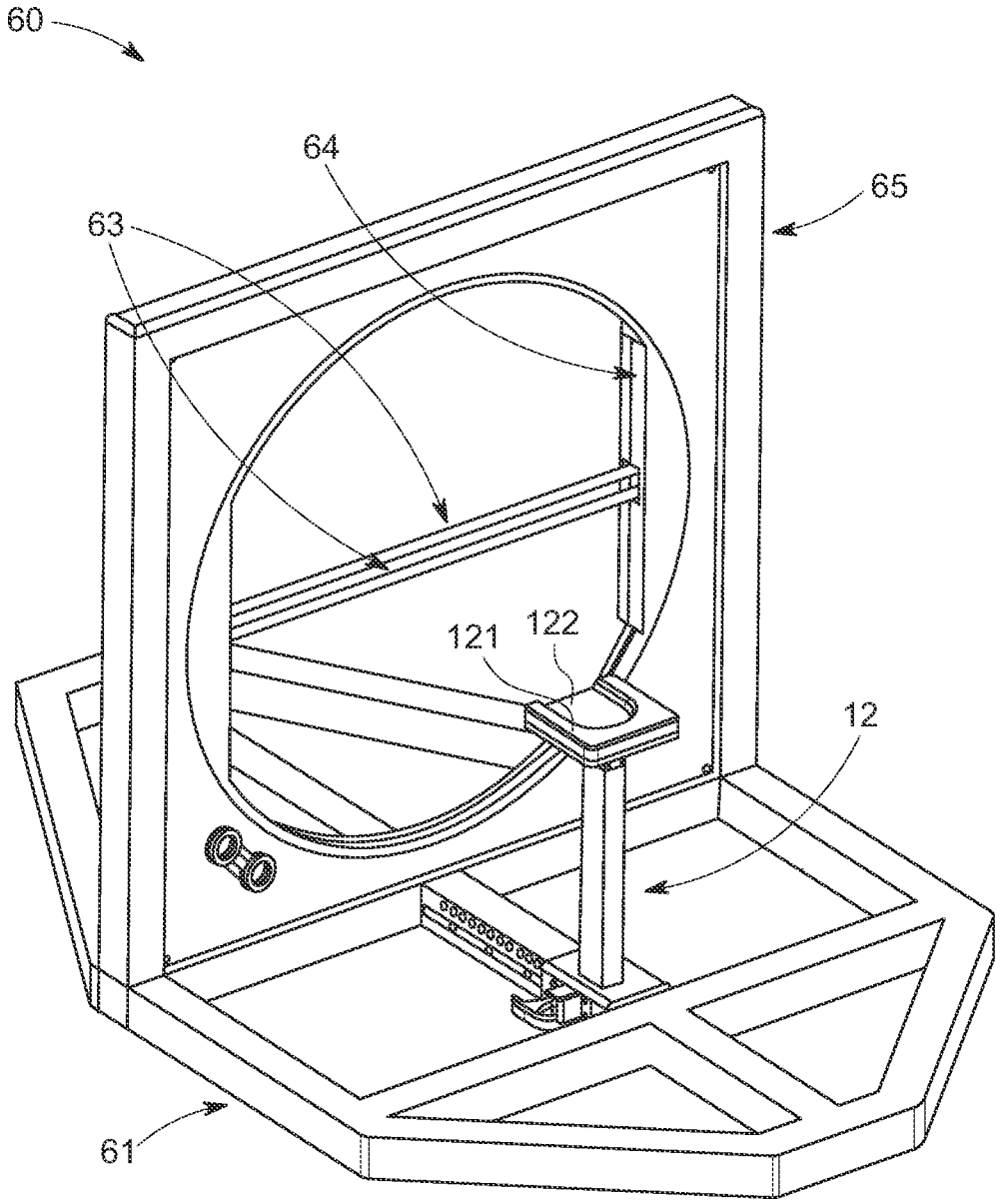
FIG. 6 illustrates an apparatus according to an alternative embodiment of the invention with isometric bars.

Turning to FIG. 6, in an additional alternative embodiment, an ankle exercise device 60 comprises a base frame 61, a heel rest 62, and isometric bars 63. The isometric bars 63 are connected to a rotational component 64 within a rotational frame member 65. The rotational component 64 rotates 90 degrees to orient the isometric bars 63 in either a horizontal or vertical orientation.

Figure 7:
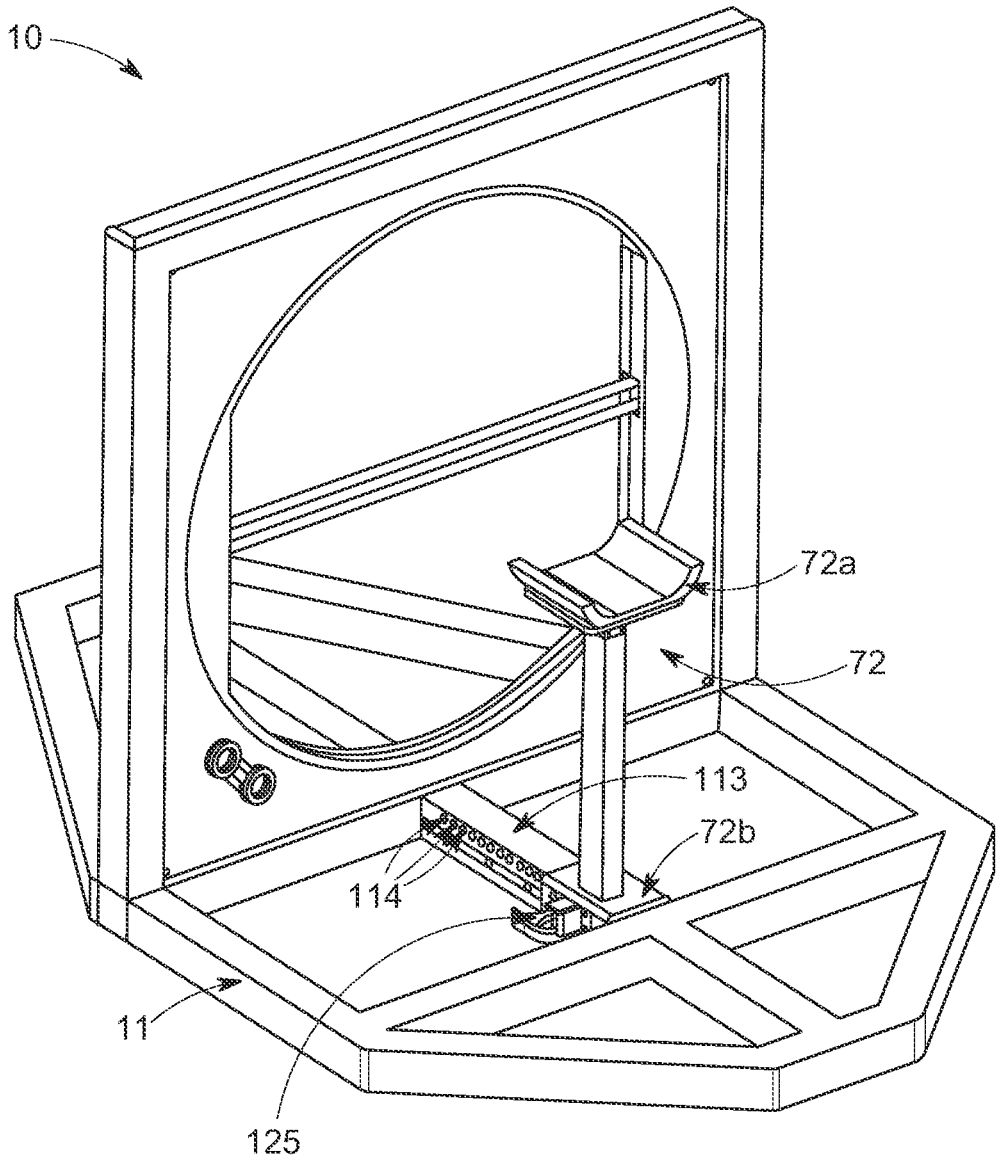
FIG. 7 illustrates an apparatus according to an alternative embodiment of the invention further including a wrist rest.

Turning next to FIG. 7, in an additional alternative embodiment, the ankle exercise device 10 can also be configured to be used as a wrist exercise device through the use of a wrist support arm 72 connected to the base frame 11. The wrist support arm 72 includes a u-shaped wrist support **72*a* that has a slidable adjustment mechanism 72*b* that slides along a central bar 113 of the base frame 11 to allow for arm size accommodation. The slidable adjustment mechanism 72*b* has a spring loaded locking pin mechanism 125 to engage with multiple holes 114 located along the central bar 113 of the base frame 11**

In a particular exemplary implementation of the ankle exerciser, the device is to be utilized in a seated position to allow for toe touch weight bearing, and partial weight bearing precautions on heel rest for post-surgical patients and without weight bearing restrictions for all other patients. A person would sit on a bench, chair, or similar seating surface and place the heel of their foot on the heel rest. The bench, chair, or similar seating surface should be adjusted so that the patient's knee is anywhere between 50 and 90 degree knee flexion. With the bands in the horizontal position the patient will be able to move their foot in plantarflexion from 0 to a maximum of 55 degrees and in dorsiflexion from 0 to a maximum of 25 degrees before hitting the end stops allowing for full active range of motion and 5 degrees over for those with greater ranges. With the bands in the vertical position the patient will be able to rotate left and right into inversion from 0 to a maximum of 35 degrees and eversion from 0 to a maximum of 25 degrees before hitting the end stops.

As will be apparent to those skilled in the art in the light of the foregoing disclosure, many alterations and modifications are possible in the practice of this invention without departing from the spirit or scope thereof. Features described above in relation to specific embodiments may be combined with features described in relation to other embodiments.

What is claimed is:

1. An exercise apparatus comprising:

a base frame;

a heel rest coupled to the base frame through a heel support base, wherein the heel rest comprises a heel support plate with a "U" shaped cutout, wherein the "U" shaped cutout is configured to cup a user's heel, and wherein the heel support plate is rotatably connected to the heel support base through a hinge assembly;

a rotational frame member;

a rotational component;

a plurality of resistance band attachment means; and a plurality of resistance bands;

wherein said rotational component is rotatably connected to the rotational frame member; wherein said plurality of resistance bands are connected to the rotational component; and wherein said rotational component rotates 90 degrees to orient the plurality of resistance bands in vertical or horizontal directions.

2. The exercise apparatus of claim 1, wherein the rotational component further comprises a rotation lock;

wherein said rotation lock locks the rotational component such that the plurality of resistance bands are in either the horizontal or vertical direction.

3. The exercise apparatus of claim 1, further comprising:

a plurality of isometric bars;

wherein said plurality of isometric bars may be placed perpendicular to the orientation of the plurality of resistance bands.

4. The exercise apparatus of claim 1, further comprising:

an electric motor configured to rotate the rotational component; and an electronic control mechanism comprising controls for the electric motor.

5. An exercise apparatus comprising:

a base frame;

a heel rest;

a rotational frame member;

a rotational component;

a plurality of resistance band attachment means;

a plurality of resistance bands;

an electric motor configured to rotate the rotational component; and an electronic control mechanism comprising controls for the electric motor;

wherein said electric motor is further configured to adjust a distance between the plurality of resistance band attachment means; and wherein said electronic control mechanism further comprises an indication of the distance between the plurality of resistance band attachment means.

6. An exercise apparatus comprising:

a base frame;

a heel rest coupled to the base frame through a heel support base, wherein the heel rest comprises a heel support plate with a "U" shaped cutout;

a rotational frame member;

a rotational component; and a plurality of isometric bars;

wherein said rotational component is rotatably connected to the rotational frame member;

wherein said plurality of isometric bars are connected to the rotational component; and wherein said rotational component rotates 90 degrees to orient the plurality of isometric bars in vertical or horizontal directions.

* * * * *